United States Patent [19]

Geiss

[11] 4,238,892

[45] Dec. 16, 1980

[54] APPARATUS FOR CLEANING CONTAINERS

[76] Inventor: Horst Geiss, Blumenstr. 9, 8871 Unterknoringen, Fed. Rep. of Germany

[21] Appl. No.: 956,235

[22] Filed: Oct. 31, 1978

[30] Foreign Application Priority Data

Oct. 31, 1977 [DE] Fed. Rep. of Germany ..... 2748830

[51] Int. Cl.[3] ..... B08B 9/08

[52] U.S. Cl. ..... 34/85; 34/73; 134/107; 134/169 R

[58] Field of Search ..... 34/72, 73, 75, 76, 85, 34/104, 243; 134/105, 107, 108, 166 R, 169 R; 220/DIG. 24, 464

[56] References Cited

U.S. PATENT DOCUMENTS

| | | | |
|---|---|---|---|
| 1,666,015 | 4/1928 | Land | 134/169 R X |
| 1,843,036 | 1/1932 | Lurry | 239/587 X |
| 1,898,378 | 2/1933 | McIntyre | 222/464 X |
| 2,064,373 | 12/1936 | Carriere et al. | 134/105 X |
| 2,259,544 | 10/1941 | Black | 134/107 X |
| 2,993,493 | 7/1961 | Edhofer | 134/107 X |
| 4,008,729 | 2/1977 | Chizinsky | 134/107 |

*Primary Examiner*—Albert J. Makay
*Assistant Examiner*—Harold Joyce

[57] ABSTRACT

An apparatus for cleaning containers which comprises a head assembly securable to an opening in the container. The head assembly has means for introducing cleaning vapor into the container, means for removing condensate from adjacent the bottom of the container, and means which include a cooler for receiving vapor from the container.

4 Claims, 1 Drawing Figure

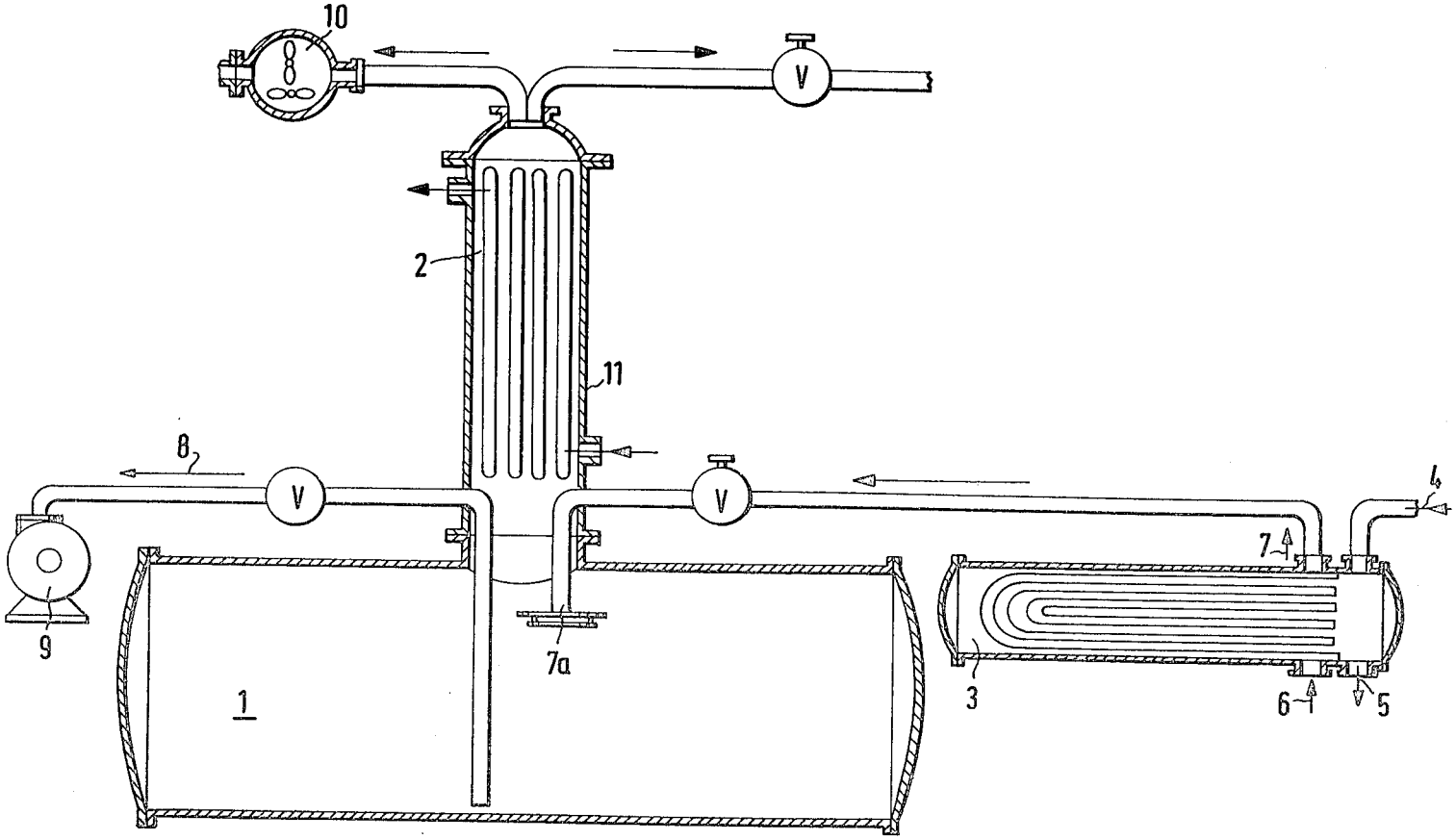
4
5
6
7
3
V
V
V
V
11
7a
2
10
1
8
9

APPARATUS FOR CLEANING CONTAINERS

This invention relates to apparatus for cleaning containers.

Manually held equipment, such as a steam lance, has previously been used for cleaning containers, such as tank cars or underground vessels, especially when the containers contain oils, tars and the like, in order to remove sticky remaining residues.

It is an object of the present invention to provide apparatus for cleaning such containers which enables penetrating cleaning of the containers to be effected without individual manual treatment, without unduly heating the containers, and with relatively low energy consumption.

According to the present invention, apparatus for cleaning containers comprises a head assembly securable to an opening in a container, said head assembly having means for introducing cleaning vapour into the container, means for removing condensate from adjacent the bottom of the container, and meaning including a cooler for receiving vapour from the container.

The apparatus may also include a heat exchanger operable to supply cleaning vapour to the vapour introducing means, an exhaust pump connected to the condensate removing means, and an exhaust fan connected to the vapour receiving means.

Advantageously, the cooler is positioned to cause vapour condensed thereby to drain into the container.

One embodiment of the invention will now be described, by way of example, with reference to the accompanying drawing, which shows a schematic view of cleaning apparatus connected to a container.

Referring to the drawing, cleaning apparatus includes a head assembly 11 secured to the inlet opening of a container 1, which may be a tank car or an underground vessel. The head assembly 11 has a solvent vapour outlet *7a* connected to a heat exchanger 3, and vapours of readily vapourizable solvent pass through the outlet *7a* from the heat exchanger 3 into the container 1. The solvents are introduced into the heat exchanger 3 through a solvent entry port 6. The heat exchanger 3 contains coil windings or exchanger pipes for formation of solvent vapours by means of steam, the steam being introduced through steam inlet duct 4 and removed through steam exit duct 5, and a solvent vapour/steam mixture passing through exit 7 to outlet *7a*.

The head assembly 11 also includes a cooler 2 which acts as a solvent vapour receiver, and which communicates with the atmosphere through an exhaust fan 10. The cooler 2 is arranged to reduce the likelihood of escape of solvent vapours to the atmosphere by condensing the vapours and returning the condensate to the container 1. For complete removal of the solvent vapours at the end of the cleaning, exhaust fan 10 can be actuated. The head assembly 11 also includes a condensate removal duct 8 to which an exhaust pump 9 is connected, the duct 8 extending to near the bottom of the container 1.

After installation of the head assembly 11 on the inlet opening of the container 1, whose walls are, for example, coated with tar or oil residues, air is removed from the container by operation of the exhaust fan 10. Also, solvent vapours and steam are caused to flow into the container 1 from heat exchanger 3 through the solvent vapour outlet *7a*, by introduction of hot steam into the heat exchanger 3 through the steam inlet duct 4 and by introduction of solvents through the solvent inlet port 6. The solvent vapour dissolves residues adhering to the walls of the container and, since some vapour condenses on the cooler walls of the container 1, a condensate film is provided which washes the container walls, the condensate flowing down the container walls towards the bottom of the container from where it is removed by exhaust duct 8.

By means of the combined chemical/liquid cleaning with the condensate flowing down the container walls, a reliable and accelerated cleaning of the container is achieved in a relatively short time, and no further treatment is usually required. The cooler 2, which may, for example, be cooled by water, reduces the likelihood of contaminating solvent vapours escaping to the atmosphere, since the solvent vapours are condensed on the cooler 2, and drain back into the container 1 for subsequent removal through the condensate exhaust duct 8.

Thus, with the present invention, there is little risk of polluting the surrounding atmosphere by solvent vapours, and compared to prior manual methods of steam cleaning, in which a container had often to be separately heated, considerably lesser quantities of cleaning materials are required. An important energy saving is achieved when comparing the steam requirement for cleaning by means of steam lances according to the prior art with the steam required by the heat exchanger described above.

Suitable chemicals for cleaning containers with apparatus in accordance with the present invention are mixtures of chlorinated hydrocarbons, such as perchloroethylene, trichloroethylene, 1, 1, 1-trichloroethylene or methylene chloride, with which can be mixed, for increasing cleaning efficiency, up to about 10% of aromatics such as benzene hydrocarbons without rendering the vapour mixture flammable or explosive.

Other embodiments within the scope of the invention will be apparent to a person skilled in the art, the scope of the invention being defined in the appended claims.

What I claim as new and desire to protect by Letters Patent of the United States is:

1. Apparatus for cleaning containers comprising a head assembly engageable with an opening in a container, said head assembly having means for introducing cleaning vapour into the container through said opening, means for removing condensate through said opening from adjacent the bottom of the container, means including a cooler for receiving vapour through said opening from the container, and exhaust fan means connected to said vapour receiving means for extracting vapour from the container through said cooler.

2. Apparatus according to claim 1 including a heat exchanger operable to supply cleaning vapour to said vapour introducing means.

3. Apparatus according to claim 1 including an exhaust pump connected to said condensate removing means.

4. Apparatus according to claim 1 wherein the cooler is positioned to cause vapour condensed thereby to drain into the container.

* * * * *